US006332993B1

(12) United States Patent
Jen

(10) Patent No.: US 6,332,993 B1
(45) Date of Patent: Dec. 25, 2001

(54) PROCESS OF MAKING HEAT-RETAINING FIBERS

(75) Inventor: Zo-Chun Jen, Taipei (TW)

(73) Assignee: Nan Ya Plastics Corporation, Taipei (TW)

( * ) Notice: Subject to any disclaimer, the term of this patent is extended or adjusted under 35 U.S.C. 154(b) by 0 days.

(21) Appl. No.: 09/397,081

(22) Filed: Sep. 16, 1999

(51) Int. Cl.[7] ..... D01D 5/098; D01D 5/16; D01D 5/30; D01F 1/10; D01F 8/04

(52) U.S. Cl. ..... 264/103; 264/168; 264/172.12; 264/172.14; 264/172.15; 264/172.17; 264/172.18; 264/177.13; 264/210.6; 264/210.8; 264/211.15; 264/211.17; 264/235.6; 264/143

(58) Field of Search ..... 264/103, 143, 264/168, 172.12, 172.14, 172.15, 172.17, 172.18, 177.13, 210.6, 210.8, 211, 211.15, 211.17, 235.6

(56) References Cited

U.S. PATENT DOCUMENTS 4,151,159 * 4/1979 Geall et al. ..... 264/210.6 X

FOREIGN PATENT DOCUMENTS

09241956-A * 9/1997 (JP) .

* cited by examiner

*Primary Examiner*—Leo B. Tentoni
(74) *Attorney, Agent, or Firm*—Bacon & Thomas

(57) ABSTRACT

A method for making heat-retaining fiber and fabrics. According to the present invention, the white conductive particles and the white particles with good radiating efficiency of far-infrared radiation are added in fiber-forming polymers to obtain the mixed composition. The fiber and fabrics made of the mixed composition is characteristic of excellent effect of heat-retaining usable for the use of requiring good heat-retaining effectiveness.

14 Claims, 2 Drawing Sheets

PROCESS OF MAKING HEAT-RETAINING FIBERS

BACKGROUND OF THE INVENTION

1. Field of the Invention

The present invention relates to processes for the production of heat-retaining fiber which is characteristic of excellent effect of heat-retaining and good radiating capacity of far-infrared radiation, thereby the fabrics and non-woven fabrics made thereof are extensively applicable for cold-proof cloth or sportswear cloth to exhibit excellent effect of heat-retaining.

2. Description of the Related Art

Since ancient times, clothes provides human three major functions, body shading, heat-retaining, and beauty. As to the heat-retaining, conventional method is to increase the weaving density and thickness, to adopt multi-layer structure, and to add fleecy filling material between the inside and outside layer in order to reduce the heat loss due to transmission and convection. However, these methods make the resultant clothes so thick, heavy and cumbersome such that they are uncomfortable for the wearer.

Japanese Examined Patent Publication No. 58-10916 and Japanese Examined Patent Publication No. 58-136891 disclose a method of adhering vaporized metal onto the surface of cloth to increase the reflection of the cloth, thereby reducing the loss of body heat. Japanese Examined Patent Publication No.2-32364 discloses a method for mixing metal particles into the fiber to reflect heat radiation, thereby reducing the loss of body heat. The conventional art mentioned above has the following disadvantages. As to the method of adhering vaporized metal onto the surface of cloth, the adhered metal is easily stripped of during wearing and cleaning. Besides, the adhering of vaporized metal is batch operation, so the economic efficiency is low. As to the method of mixing metal particles into the fiber, in order to have the best effect of reflecting, the metal particles should adopt thin laminated metal powders having the average particle size of 1~100 $\mu$m and the adding amount thereof should be 1~30%, therefore, in the processes of spinning and stretching, the pressure of spin pack assembly will rise very rapidly, situations of filament-flying and filament-breaking will increase, the production efficiency will go down. Besides, the metal particles in the fiber will make the heat-resistance and stability thereof worse.

It is also disclosed a method to obtain heat-retaining fiber by mixing ceramic powders having capacity of far-infrared radiation into fiber. Japanese Examined Patent Publication No. 2-160921 discloses far-infrared radiation ceramic powders selected from the group consisting of zirconium oxide, aluminum oxide, and magnesium oxide. Japanese Examined Patent Publication No. 2-259110 and Japanese Examined Patent Publication No. 1-314723 disclose far-infrared radiation ceramic powders consisting of silicon dioxide and titanium dioxide. Japanese Examined Patent Publication No. 63-182444 discloses far-infrared radiation ceramic powders selected from the group consisting of aluminum oxide, zirconium oxide, and magnesium oxide. Japanese Examined Patent Publication No. 63-126971 and Japanese Examined Patent Publication No. 63-92720 disclose far-infrared radiation ceramic powders selected from the group consisting of zirconium oxide, aluminum oxide, magnesium oxide (purity above 95%) and mixtures of two or more mentioned-above. British Patent Publication No. GB 2303375A discloses far-infrared radiation ceramic powders selected from the group consisting of zirconium oxide, zirconium silicate, silicon dioxide, and titanium dioxide. When the far-infrared radiation ceramic powders described above are heated, they can emit the far-infrared radiation which can be easily absorbed by human body and emitting efficiency thereof is very high. Therefore, they can absorb the body heat of human body after mixing into fibers and then emit the far-infrared radiation to warm the human body, thereby raising the effect of heat-retaining. Nevertheless, the efficiency of absorbing solar energy of the far-infrared radiation ceramic powders is not good, therefore, they can't efficiently convert solar energy into far-infrared radiation which can be easily absorbed by human body. Hence, the effectiveness of heat-retaining is still required to be further improved.

It is also provided with a method of mixing powders having capacity of adsorbing solar energy. Japanese Examined Patent Publication No. 1-132816 utilizes inorganic particles such as carborundum. Japanese Examined Patent Publication No. 4-257308 and Japanese Examined Patent Publication No. 1-314716 utilizes tin oxide particles doped with stibium oxide or other inorganic particles coated by this special-treated tin oxide. Although inorganic particles such as carborundum have good capacity of absorbing solar energy, while the color thereof is black, therefore the resultant fiber is also black and it is very difficult to be made into clothing with a variety of colors. Tin oxide particles doped with stibium oxide or other inorganic particles coated by this special-treated tin oxide have good capacity of absorbing solar energy and the color thereof is white, but the emitting efficiency of far-infrared radiation thereof is not good, therefore, they can't efficiently convert solar energy into far-infrared radiation which can be easily absorbed by human body. Hence, the methods mentioned above are still required to be further improved.

SUMMARY OF THE INVENTION

It is a primary object of the present invention to provide a heat-retaining fiber having good capacity of absorbing solar energy, excellent efficiency of radiating far-infrared radiation, and a white appearance which is easy to be stained.

It is another object of the present invention to provide a method for producing heat-retaining fiber having good capacity of absorbing solar energy, excellent efficiency of radiating far-infrared radiation, and a white appearance which is easy to be stained.

DETAILED DESCRIPTION OF THE PREFERRED EMBODIMENT

Figure 1:
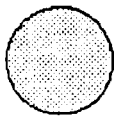
FIGS. 1–30 show the morphology of the heat-retaining fiber in accordance with the present invention, wherein the shade portion is polymer having the white conductive particles and the white particles with good radiating efficiency of far-infrared radiation, and the blank portion is polymer without the particles of the present invention.
Figure 2:
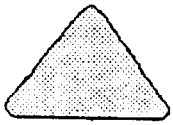
Figure 3:
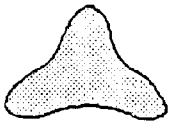
Figure 4:
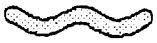
Figure 5:
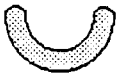
Figure 6:
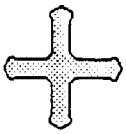
Figure 7:
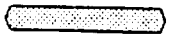

To accomplish the objectives mentioned above, the practitioner of the present invention discovers by thorough research that fibers and fabrics of heat-retaining, having excellent capacity of absorbing solar energy and efficiency of radiating far-infrared radiation can be made from the fiber-forming polymer adding with (1) white conductive particles and (2) white particles with good radiating efficiency of far-infrared radiation.

The white conductive particles of the present invention should have a very low resistance, and thus is a good conductor. The magnitude of the resistance is related to its capacity of absorbing solar energy. In order to ensure the excellent capacity of absorbing solar energy, the resistance is keeping under 1000Ω.cm, preferably under 100Ω.cm, best under 50Ω.cm. The white conductive particles according to the present invention are made of the following materials of conductive tin oxide particles, conductive titanium dioxide particles, conductive barium sulfate particles, conductive potassium titanate particles, and mixtures of any two or more mentioned above.

There are a variety of manufacturing methods for the white conductive particles, wherein one of them is utilizing the tin oxide particles. The tin oxide is a kind of semiconductor, which can be doped with a small amount of other elements (commonly adopted compounds comprising stibium or fluorine, other elements such as phosphonium, arsenic, bromine, chlorine, iodine is also feasible) to enhance its conductivity, thereby obtaining the conductive tin oxide particles. The white conductive particles can also be made by coating other non-conductive inorganic particles (i.e. titanium dioxide, barium sulfate, calcium carbonate, zinc oxide, aluminum oxide, and magnesium oxide . . . etc.) with the conductive tin oxide.

The white conductive particles can absorb solar energy efficiently other than having conductivity. The reason why the white conductive particles can absorb solar energy efficiently is having free electrons therein. When solar energy irradiates onto the surface of the white conductive particles, the free electrons of outer shell will absorb the energy and move around freely inside the conductive particles, thereby distributing the energy evenly over the whole, therefore the efficiency of absorbing solar energy is very excellent.

In accordance with the present invention, the characteristics of the white particles with good radiating efficiency of far-infrared radiation are as follow. The average radiation rate is above 65% at a temperature under 30° C. and wavelength between 4~25 μm. This kind of particles are selected from the group consisting of zirconium oxide, aluminum oxide, titanium dioxide, kaolin, magnesium oxide, and mixtures of any two or more mentioned above.

As to the adding amount of the particles mentioned above, the adding amount of the white conductive particles is 0.05–20% by weight based on the total weight of the fiber. If the adding content is less than 0.05% by weight, while the resultant fiber exhibits insufficient capacity of retaining heat by absorbing solar energy. Also, if the adding content is more than 20% by weight, its effect on further raising the capacity of absorbing solar energy is limited, and the resultant fiber exhibits a decreased fiber-forming property and the toughness and tensile strength of the fiber is reduced. The adding amount of the white particles with good radiating efficiency of far-infrared radiation is 0.1–20% by weight based on the total weight of the fiber. If the adding content is less than 0.1% by weight, while the resultant fiber exhibits low radiating efficiency of far-infrared radiation and bad heat-retaining property. Also, if the adding content is more than 20% by weight, while the resultant fiber exhibits a decreased fiber-forming property and the toughness and tensile strength of the fiber is reduced. The total adding amount of the white conductive particles and the white particles with good radiating efficiency of far-infrared radiation mentioned above is under 20% by weight.

The average particle size of the white conductive particles and the white particles with good radiating efficiency of far-infrared radiation mentioned above is under 5 μm, preferably under 1 μm, best under 0.5 μm. If the size of the particles is too large, the effect of heat-retaining tends to decrease, and the pressure of spin pack assembly will rise so rapidly that a variety of problems such as filament-flying, filament-breaking or filaments being prone to break in the successive stretching process will arise.

The characteristics of the present invention is adding the white conductive particles and the white particles with good radiating efficiency of far-infrared radiation at the same time. The effect of the white conductive particles is absorbing solar energy thoroughly and transforming the absorbed solar energy into heat energy. The effect of the white particles with good radiating efficiency of far-infrared radiation is converting the heat energy efficiently into the far-infrared radiation which can be easily absorbed by human body. The cumulative effect of these two types of particles, not only absorbing solar energy thoroughly but also converting the absorbed solar energy efficiently into the far-infrared radiation which can be easily absorbed by human body, is more excellent and surprising than that being added independently. The adding amount of these two types of particles is as mentioned above, wherein the adding amount of the white conductive particles is 0.05–20% by weight based on the total weight of the fiber; the adding amount of the white particles with good radiating efficiency of far-infrared radiation is 0.1–20% by weight based on the total weight of the fiber; the total adding amount of these two types of particles is under 20% by weight.

In order to accomplish the excellent effect of heat-retaining, the white conductive particles and the white particles with good radiating efficiency of far-infrared radiation mentioned above must fulfill the requirement of characteristics discussed above. That is, the resistance of the white conductive particles should keep under 1000Ω.cm, preferably under 100Ω.cm, best under 50Ω.cm. If the resistance is larger than 1000Ω.cm, then the efficiency of absorbing solar energy is getting bad and the capacity of heat-retaining is insufficient. The average radiation rate of the white particles with good radiating efficiency of far-infrared radiation should be above 65% at a temperature under 30° C. and wavelength between 4~25 μm. If the average radiation rate is smaller above 65%, then the absorbed solar energy can't be converted thoroughly to the far-infrared radiation which can be easily absorbed by human body.

The white conductive particles and the white particles with good radiating efficiency of far-infrared radiation described above may be added in the synthetic stage of polymer, or directly mixed with the polymer material in the spinning of filaments, or made into concentrated mother particles, which, in turn, mixed with polymer material and diluted to the predetermined concentration. The adding order of these two types of particles has no special limitation, either the white conductive particles or the white particles with good radiating efficiency of far-infrared radiation can be added first, or they can be added simultaneously.

The fiber-forming polymer of the present invention is thermoplastic polymeric material, which can be formed into filaments, comprising polyester, polyamide, polyethylene, polypropylene, and substantially one kind of the above-mentioned polymer but denaturalized by co-polymerized monomer, or co-polymerized with compound of multi-functional group as long as the fiber-forming property unaffected.

The heat-retaining fiber described above can be added with a certain amount of stabilizer, antioxidant, ultraviolet absorbent, shading reagent, pigment, and fluorescence whitener, if necessary in practical, this will not affect the property of heat-retaining thereof.

Figure 8:
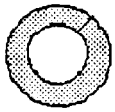
Figure 9:
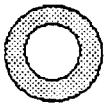
Figure 10:
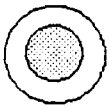
Figure 11:
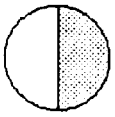
Figure 12:
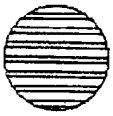
Figure 13:
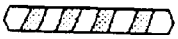
Figure 14:
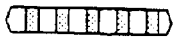
Figure 15:
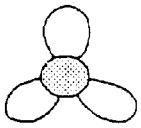
Figure 16:
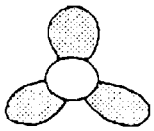
Figure 17:
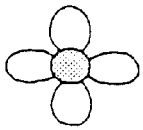
Figure 18:
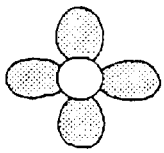
Figure 19:
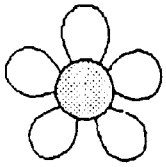
Figure 20:
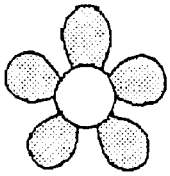
Figure 21:
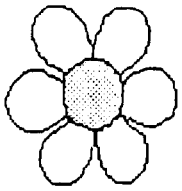
Figure 22:
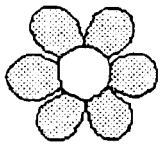
Figure 23:
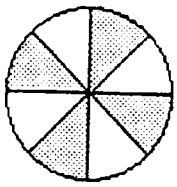
Figure 24:
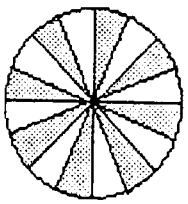
Figure 25:
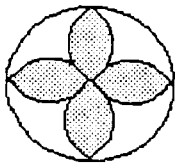
Figure 26:
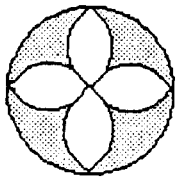
Figure 27:
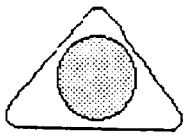
Figure 28:
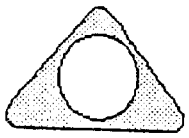
Figure 29:
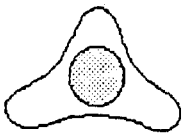
Figure 30:
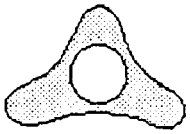

The morphology of the heat-retaining fiber in accordance with the present invention is illustrated by several examples of cross-sectional profile of the fiber wherein the shade portion is polymer having the white conductive particles and the white particles with good radiating efficiency of far-infrared radiation, and the blank portion is polymer without the particles of the present invention. FIG. 1 illustrates a fiber having a circular cross-sectional profile. FIG. 2 to FIG. 7 illustrates fibers having a heteromorphic cross-sectional profile. FIG. 8 illustrates a fiber having a hollow cross-sectional profile. FIG. 9 and FIG. 10 illustrates conjugate fibers having a core-in-sheath cross-sectional profile, wherein the sheath in FIG. 9 comprises the particles of the present invention, and the core in FIG. 10 comprises the particles of the present invention. FIG. 11 illustrates a conjugate fiber having a side-by-side cross-sectional profile. FIG. 12 illustrates a multi-layer conjugate fiber having a circular cross-sectional profile. FIG. 13 and FIG. 14. illustrates a multi-layer conjugate fiber having a planiform cross-sectional profile. FIG. 15 to FIG. 22 illustrates conjugate fibers having a poly-foliiform cross-sectional profile. FIG. 23 to FIG. 26 illustrates conjugate fibers having a division cross-sectional profile. FIG. 27 and FIG. 28 illustrates conjugate fibers having a triangular heteromorphic cross-sectional profile. FIG. 29 to FIG. 30 illustrates conjugate fibers having a Y-shape heteromorphic cross-sectional profile.

As a matter of fact, the fiber of the present invention can have a variety of cross-sectional profiles which is not limited to those illustrated in figures as long as it can be made by the technique used in the fiber fabrication art. Those skilled in the art can make sue of the present invention to fabricate heat-retaining fiber having a variety of cross-sectional profiles, wherein the polymer having the particles of the present invention can be the same with or different from the polymer without the particles of the present invention. The ratio of the polymer having the particles of the present invention in the conjugate fiber has no special limitation, it depends upon the desired effect of heat-retaining. The higher the ratio of the polymer having the particles of the present invention in the conjugate fiber is, the better the effect of heat-retaining is. Of course, the quantity of the particles of the present invention in the polymer also affect the effect of heat-retaining, wherein the key is as follows: the adding amount of the white conductive particles and the white particles with good radiating efficiency of far-infrared radiation in accordance with the present invention should within the range discussed above based on the total weight of the fiber, the adding amount of the white conductive particles is 0.05–20% by weight; the adding amount of the white particles with good radiating efficiency of far-infrared radiation is 0.1–20% by weight; the total adding amount of these two types of particles is under 20% by weight.

EFFECTIVENESS OF THE INVENTION

As described above, the present invention adds two types of particles with different function—the white conductive particles and the white particles with good radiating efficiency of far-infrared radiation—at the same time in the fiber-forming polymer. Because of the cumulative effect of these two types of particles with different function, thereby not only absorbing solar energy thoroughly but also converting the absorbed solar energy efficiently to the far-infrared radiation which can be easily absorbed by human body, thereby the resultant fiber and fabrics having excellent effect of heat-retaining preferable for the use of heat-retaining such as cold-proof cloth or sportswear cloth.

Hereinafter described the analytical methods in relation to the present invention.

(1) Effectiveness of Heat-retaining

Test and record the temperature of the back of the fabrics by a thermometer under the irradiation of a light source (250 W lamp) in the environment of 23° C., 65% RH. Compare the temperature with the fabrics without the particles of the present invention, and calculate the temperature difference, which, in turn, representing for the effectiveness of heat-retaining.

(2) IV (Infinite Viscosity)

Dissolve the polyester sample in the mixed solvent of phenol and 1,1,2,2 -tetrachloroethane (3:2 by weight) and determine the IV at a temperature of 25° C.

(3) RV (Relative Viscosity)

Dissolve the polyamide sample in concentrated sulfuric acid and determine the RV at a temperature of 25° C.

(4) MI (Melting Index)

Determined by the procedure according to ASTM D-1238.

EXAMPLES

Hereinafter the present invention will be further explained by the following examples. Of course, the scope of the present invention is not limited by the illustrative embodiments.

Example 1

2% by weight of the white conductive titanium dioxide of 10Ω.cm (resistance) and 0.3 μm (average particle size), 3% by weight of zirconium oxide of 0.3 μm (average particle size), and 95% by weight of polyester (IV 0.645) are mixed and melted with a two-spindle extruder, then quenched by water, cut into particles to obtain the mixed composition. The mixed composition is melted with an extruder and then spun into filaments, wherein the cross-sectional profile is as FIG. 1. The partially stretched filament of 125 denier per 36 filaments is obtained at a temperature of 290° C. and a rolling velocity of 3200 m/min. The partially stretched filament is drawing and pseudo-spun into the processing yarn of 75 denier per 36 filaments with a spindle-module pseudo-spinning machine. The processing yarn is used as warp yarns and weft yarns to obtain the plainwoven fabrics by weaving. Test the effectiveness of heat-retaining of the plainwoven fabrics—the temperature of the back of the fabrics is 52.3° C., ΔT=6.6° C.

Comparative Example 1

2% by weight of the white conductive titanium dioxide of 10Ω.cm (resistance) and 0.3 μm (average particle size) and 98% by weight of polyester (IV 0.645) are mixed and melted with a two-spindle extruder, then quenched by water, cut into particles to obtain the mixed composition. The following procedures are the same as Example 1. Test the effectiveness of heat-retaining of the obtained plainwoven fabrics—the temperature of the back of the firics is 50.3° C., ΔT=4.6° C.

Comparative Example 2

3% by weight of of zirconium oxide of 0.3 μm (average particle size) and 97% by weight of weight parts of polyester (IV 0.645) are mixed and melted with a two-spindle extruder, then quenched by water, cut into particles to obtain the mixed composition. The following procedures are the same as Example 1. Test the effectiveness of heat-retaining of the obtained plainwoven fabrics—the temperature of the back of the fabrics is 46.5° C., ΔT=0.8° C.

Comparative Example 3

This example is not added with the particles of the present invention in order to be a blank comparison. 100% by weight of polyester (IV 0.645)—without any additives—is melted with an extruder and spun into filaments, and the following procedures are the same as Example 1. Test the effectiveness of heat-retaining of the obtained plainwoven fabrics—the temperature of the back of the fabrics is 45.7° C., ΔT=0° C.

The results of Example 1 and Comparative Example 1–3 in accordance with the present invention are shown in Table 2.

TABLE 1

| | Wt % of white conductive titanium dioxide | Wt % of zirconium oxide | The effectiveness of heat-retaining the temperature of the back ° C. | ΔT ° C. |
|---|---|---|---|---|
| Example 1 | 2 | 3 | 52.3 | 6.6 |
| Comparative Example 1 | 2 | 0 | 50.3 | 4.6 |
| Comparative Example 2 | 0 | 3 | 46.5 | 0.8 |
| Comparative Example 3 | 0 | 0 | 45.7 | 0 |

Example 2

Replace zirconium oxide in Example 1 with aluminum oxide of 0.4 μm (average particle size) and the other procedures are the same as Example 1. Test the effectiveness of heat-retaining of the obtained plainwoven fabrics—the temperature of the back of the fabrics is 51.8° C., ΔT=6.1° C.

Example 3

Replace zirconium oxide in Example 1 with kaolin of 0.45 μm (average particle size) and the other procedures are the same as Example 1. Test the effectiveness of heat-retaining of the obtained plainwoven fabrics—the temperature of the back of the fabrics is 51.5° C., ΔT=5.8° C.

Example 4

Replace zirconium oxide in Example 1 with magnesium oxide of 0.4 μm (average particle size) and the other procedures are the same as Example 1. Test the effectiveness of heat-retaining of the obtained plainwoven fabrics—the temperature of the back of the fabrics is 51.7° C., ΔT=6.0° C.

Comparative Example 4

3% by weight of aluminum oxide of 0.4 μm (average particle size) and 97% by weight of polyester (IV 0.645) are mixed and melted with a two-spindle extruder, then quenched by water, cut into particles to obtain the mixed composition. The following procedures are the same as Example 1. Test the effectiveness of heat-retaining of the obtained plainwoven fabrics—the temperature of the back of the fabrics is 46.4° C., ΔT=0.7° C.

Comparative Example 5

Replace aluminum oxide in Comparative Example 4 with kaolin of 0.45 μm (average particle size) and the other procedures are the same as Comparative Example 4. Test the effectiveness of heat-retaining of the obtained plainwoven fabrics—the temperature of the back of the fabrics is 46.2° C., ΔT=5.5° C.

Comparative Example 6

Replace aluminum oxide in Comparative Example 4 with magnesium oxide of 0.4 μm (average particle size) and the other procedures are the same as Comparative Example 4. Test the effectiveness of heat-retaining of the obtained plainwoven fabrics—the temperature of the back of the fabrics is 46.3° C., ΔT=0.6° C.

The results of Example 2–4 and Comparative Example 4–6 in accordance with the present invention are shown in Table 2.

TABLE 2

| | Wt % of white conductive titanium dioxide | Wt % of aluminum oxide | Wt % of kaolin | Wt % of magnesium oxide | The effectiveness of heat-retaining The temperature of the back ° C. | ΔT ° C. |
|---|---|---|---|---|---|---|
| Example 2 | 2 | 3 | 0 | 0 | 51.8 | 6.1 |
| Example 3 | 2 | 0 | 3 | 0 | 51.5 | 5.8 |
| Example 4 | 2 | 0 | 0 | 3 | 51.7 | 6.0 |
| Comparative Example 4 | 0 | 3 | 0 | 0 | 46.4 | 0.7 |
| Comparative Example 5 | 0 | 0 | 3 | 0 | 46.2 | 0.5 |
| Comparative Example 6 | 0 | 0 | 0 | 3 | 46.3 | 0.6 |

Example 5

2% by weight of the white conductive barium sulfate of 50Ω.cm (resistance) and 0.3 μm (average particle size), 3% by weight of aluminum oxide, and 95% by weight of polyester (IV 0.645) are mixed and melted with a two-spindle extruder, then quenched by water, cut into particles to obtain the mixed composition. The other fabricated procedures of the plainwoven fabrics are the same as Example 1. Test the effectiveness of heat-retaining of the obtained plainwoven fabrics—the temperature of the back of the fabrics is 51.5° C., ΔT=5.8° C.

Example 6

2% by weight of the white conductive potassium titanate of 5Ω.cm (resistance) and 0.3 μm (average particle size), 3% by weight of zirconium oxide, and 95% by weight of polyester (IV 0.645) are mixed and melted with a two-spindle extruder, then quenched by water, cut into particles to obtain the mixed composition. The other fabricated procedures of the plainwoven fabrics are the same as Example 1. Test the effectiveness of heat-retaining of the obtained plainwoven fabrics—the temperature of the back of the fabrics is 52.7° C., ΔT=7.0° C.

Comparative Example 7

2% by weight of the white conductive barium sulfate of 50 Ω.cm (resistance) and 0.3 μm (average particle size) and 98% by weight of polyester (IV 0.645) are mixed and melted with a two-spindle extruder, then quenched by water, cut into particles to obtain the mixed composition. The other fabricated procedures of the plainwoven fabrics are the same as Example 1. Test the effectiveness of heat-retaining of the obtained plainwoven fabrics—the temperature of the back of the fabrics is 49.7° C., ΔT=4.0° C.

Comparative Example 8

2% by weight of the white conductive potassium titanate of 5 Ω.cm (resistance) and 0.3 μm (average particle size) and 98% by weight of polyester (IV 0.645) are mixed and melted with a two-spindle extruder, then quenched by water, cut into particles to obtain the mixed composition. The other fabricated procedures of the plainwoven fabrics are the same as Example 1. Test the effectiveness of heat-retaining of the obtained plainwoven fabrics—the temperature of the back of the fabrics is 50.6° C., ΔT=4.9° C.

The results of Example 5, 6 and Comparative Example 7, 8 in accordance with the present invention are shown in Table 3.

TABLE 3

| | Wt % of white conductive barium sulfate | Wt % of white conductive potassium titanate | Wt % of zirconium oxide | Wt % of aluminum oxide | The effectiveness of heat-retaining | |
|---|---|---|---|---|---|---|
| | | | | | The temperature of the back ° C. | ΔT ° C. |
| Example 5 | 2 | 0 | 0 | 3 | 51.5 | 5.8 |
| Example 6 | 0 | 2 | 3 | 0 | 52.7 | 7.0 |
| Comparative Example 7 | 2 | 0 | 0 | 0 | 49.7 | 4.0 |
| Comparative Example 8 | 0 | 2 | 0 | 0 | 50.6 | 4.9 |

Example 7

1% by weight of the white conductive titanium dioxide of 10Ω.cm (resistance), 1% weight parts of the white conductive potassium titanate of 5Ω.cm (resistance), 3% by weight of kaolin, and 95% by weight of polyester (IV 0.645) are mixed and melted with a two-spindle extruder, then quenched by water, cut into particles to obtain the mixed composition. The other fabricated procedures of the plainwoven fabrics are the same as Example 1. Test the effectiveness of heat-retaining of the obtained plainwoven fabrics—the temperature of the back of the fabrics is 52.0° C., ΔT=6.3° C.

Example 8

1% by weight of the white conductive titanium dioxide of 10Ω.cm (resistance), 2% by weight of the white conductive potassium titanate of 5Ω.cm (resistance), 1% by weight of zirconium oxide, 1% by weight of aluminum oxide, 1% by weight of magnesium oxide, and 94% by weight of polyester (IV 0.645) are mixed and melted with a two-spindle extruder, then quenched by water, cut into particles to obtain the mixed composition. The other fabricated procedures of the plainwoven fabrics are the same as Example 1. Test the effectiveness of heat-retaining of the obtained plainwoven fabrics—the temperature of the back of the fabrics is 53.5° C., ΔT=7.8° C.

Comparative Example 9

1% by weight of the white conductive titanium dioxide of 10Ω.cm (resistance), 2% by weight of the white conductive potassium titanate of 5Ω.cm (resistance), and 97% by weight of polyester (IV 0.645) are mixed and melted with a two-spindle extruder, then quenched by water, cut into particles to obtain the mixed composition. The other fabricated procedures of the plainwoven fabrics are the same as Example 1. Test the effectiveness of heat-retaining of the obtained plainwoven fabrics—the temperature of the back of the firics is 52.0° C., ΔT=6.3° C.

Comparative Example 10

1% by weight of zirconium oxide, 1% by weight of aluminum oxide, 1% by weight of magnesium oxide, and 97% by weight of polyester (IV 0.645) are mixed and melted with a two-spindle extruder, then quenched by water, cut into particles to obtain the mixed composition. The other fabricated procedures of the plainwoven fabrics are the same as Example 1. Test the effectiveness of heat-retaining of the obtained plainwoven fabrics—the temperature of the back of the fabrics is 46.3° C., ΔT=0.6° C.

The results of Example 7, 8 and Comparative Example 9, 10 in accordance with the present invention are shown in Table 4.

TABLE 4

| | Wt % of white conductive titanium dioxide | Wt % of white conductive potassium titanate | Wt % of zirconium in oxide | Wt % of aluminum oxide | Wt % of kaolin | Wt % of magnesium oxide | The effectiveness of heat-retaining | |
|---|---|---|---|---|---|---|---|---|
| | | | | | | | The temperature of the back ° C. | ΔT ° C. |
| Example 7 | 1 | 1 | 0 | 0 | 3 | 0 | 52.0 | 6.3 |
| Example 8 | 1 | 2 | 1 | 1 | 0 | 1 | 53.5 | 7.8 |
| Comparative Example 9 | 1 | 2 | 0 | 0 | 0 | 0 | 52.0 | 6.3 |
| Comparative Example 10 | 0 | 0 | 1 | 1 | 0 | 1 | 46.3 | 0.6 |

Example 9

1% by weight of the white conductive barium sulfate of 50Ω.cm (resistance), 2% by weight of the white conductive potassium titanate of 5Ω.cm (resistance), 0.5% by weight of zirconium oxide, 1% by weight of aluminum oxide, 0.5% by weight of titanium dioxide, and 95% by weight of polyester (IV 0.645) are mixed and melted with a two-spindle extruder, then quenched by water, cut into particles to obtain the mixed composition. The other fabricated procedures of the plainwoven fabrics are the same as Example 1. Test the effectiveness of heat-retaining of the obtained plainwoven fabrics—the temperature of the back of the fabrics is 53.0° C., ΔT=7.3° C.

Comparative Example 11

1% by weight of the white conductive barium sulfate of 50Ω.cm (resistance), 2% by weight of the white conductive potassium titanate of 5Ω.cm (resistance), and 97% by weight of polyester (IV 0.645) are mixed and melted with a two-spindle extruder, then quenched by water, cut into particles to obtain the mixed composition. The other fabricated procedures of the plainwoven fabrics are the same as Example 1. Test the effectiveness of heat-retaining of the obtained plainwoven fabrics—the temperature of the back of the fabrics is 51.7° C., ΔT=6.0° C.

Comparative Example 12

0.5% by weight of zirconium oxide, 1% by weight of aluminum oxide, 0.5% by weight of titanium dioxide, and 98% by weight of polyester (IV 0.645) are mixed and melted with a two-spindle extruder, then quenched by water, cut into particles to obtain the mixed composition. The other fabricated procedures of the plainwoven fabrics are the same as Example 1. Test the effectiveness of heat-retaining of the obtained plainwoven fabrics—the temperature of the back of the fabrics is 46.1° C., ΔT=0.4° C.

The results of Example 9 and Comparative Example 11, 12 in accordance with the present invention are shown in Table 5.

TABLE 5

| | Wt % of white conductive barium sulfate | Wt % of white conductive potassium titanate | Wt % of zirconium oxide | Wt % of aluminum oxide | Wt % of titanium dioxide | The effectiveness of heat-retaining | |
|---|---|---|---|---|---|---|---|
| | | | | | | The temperature of the back ° C. | ΔT ° C. |
| Example 9 | 1 | 2 | 0.5 | 1 | 0.5 | 53.0 | 7.3 |
| Comparative Example 11 | 1 | 2 | 0 | 0 | 0 | 51.7 | 6.0 |
| Comparative Example 12 | 0 | 0 | 0.5 | 1 | 0.5 | 46.1 | 0.4 |

Example 10

2% by weight of the white conductive titanium dioxide of 10Ω.cm (resistance), 1% by weight of the white conductive barium sulfate of 50Ω.cm (resistance), 1.5% by weight of zirconium oxide, 0.5% by weight of titanium dioxide, and 95% by weight of polyester (IV 0.645) are mixed and melted with a two-spindle extruder, then quenched by water, cut into particles to obtain the mixed composition. The other fabricated procedures of the plainwoven fabrics are the same as Example 1. Test the effectiveness of heat-retaining of the obtained plainwoven fabrics—the temperature of the back of the fabrics is 52.7° C., ΔT=7.0° C.

Example 11

The fabricated procedures of the plainwoven fabrics are the same as Example 1 in addition to changing the cross-sectional profile thereof into the hollow cross-sectional profile illustrated in FIG. 8. Test the effectiveness of heat-retaining of the obtained plainwoven fabrics—the temperature of the back of the fabrics is 52.8° C., ΔT=7.1° C.

The results of Example 1 and 11 in accordance with the present invention are shown in Table 6.

TABLE 6

| | Wt % of white conductive titanium dioxide | Wt % of zirconium oxide | The cross-sectional profile | The effectiveness of heat-retaining | |
|---|---|---|---|---|---|
| | | | | The temperature of the back ° C. | ΔT ° C. |
| Example 1 | 2 | 3 | FIG. 1 (solid) | 52.3 | 6.6 |
| Example 11 | 2 | 3 | FIG.8 (hollow) | 52.8 | 7.1 |

12% by weight of the white conductive potassium titanate of 5Ω.cm (resistance), 18% by weight of zirconium oxide, and 70% by weight of polyester (IV 0.580) are mixed and melted with a two-spindle extruder, then quenched by water, cut into particles to obtain the mother particles of the mixed composition. The mother particles of the mixed composition is premixed with polyester (IV0.645) at a ratio of 1:2 by weight, then mixed and melted with an extruder, which, in turn, will be used as the sheath of conjugate fiber, wherein the core of conjugate fiber is polyester (IV0.645). The two polymer components are fed into a core-in-sheath type conjugate filament-spinning machine, and the cross-sectional profile of the resultant conjugate fiber is as FIG. 9. The spinning ratio of the cores to the sheaths is 50/50 by weight. The unstretched filament of 7 denier per filament is obtained at a spinning temperature of 285° C. and a rolling velocity of 3200 m/min through an aperture of 0.25 mm ϕ. Then bunching the unstretched filament into cotton bundle of 600,000 denier, which, in turn, is drawn at a temperature of 80° C. at a draw ratio of 3.6, heat-set at 160° C., crimped with a crimper, dried at 80° C.,and cut into staple fibers which is 51 mm in length and 2 denier per filament. The staple fibers is weaving into yarns of 30'S, which, in turn, is used as warp yarns and weft yarns to obtain the plainwoven fabrics by weaving. Test the effectiveness of heat-retaining of the plainwoven fabrics—the temperature of the back of the fabrics is 52.9° C., ΔT=7.2° C.

Example 3

60% by weight of the staple fibers (Example 12) comprising the particles of the present invention and 40% by weight of the thermally bondable polyester staple fibers are mixed, carded, knitted, thermally bonded and then fabricated into nonwoven fabrics. Test the effectiveness of heat-retaining of the nonwoven fabrics—the temperature of the back of the fabrics is 50.0° C., ΔT=5.0° C.

Comparative Example 13

Replace the staple fibers comprising the particles of the present invention in Example 13 with the common polyester staple fibers without the particles of the present invention, and the other procedures are the same as Example 13. Test the effectiveness of heat-retaining of the obtained nonwoven fabrics—the temperature of the back of the fabrics is 45.0° C., ΔT=0° C.

Example 14

12% by weight of the white conductive potassium titanate of 5Ω.cm (resistance), 18% by weight of zirconium oxide, and 70% by weight of Nylon 6 (RV2.4) are mixed and melted with a two-spindle extruder, then quenched by water, cut into particles to obtain the mother particles of the mixed composition. The mother particles of the mixed composition is premixed with Nylon 6 (RV2.47) at a ratio of 1:2 by weight, then mixed and melted with an extruder, which, in turn, will be used as the sheath of conjugate fiber, wherein the core of conjugate fiber is polyester (IV0.645). The two polymer components are fed into a core-in-sheath type conjugate filament-spinning machine, and the cross-sectional profile of the resultant conjugate fiber is as FIG. 9. The spinning ratio of the cores to the sheaths is 50/50 by weight. The unstretched filament of 7 denier per filament is obtained at a spinning temperature of 283° C. and a rolling velocity of 1100 m/min through an aperture of 0.25 mm ϕ. Then bunching the unstretched filament into cotton bundle of 600,000 denier, which, in turn, is drawn at a temperature of 80° C. at a draw ratio of 3.6, heat-set at a temperature of 160° C., crimped with a crimper, dried at 80° C., and cut into staple fibers which is 51 mm in length and 2 denier per filament. The staple fibers is weaving into yarns of 30'S, which, in turn, is used as warp yarns and weft yarns to obtain the plainwoven fabrics by weaving. Test the effectiveness of heat-retaining of the plainwoven fabrics—the temperature of the back of the fabrics is 52.8° C., ΔT=7.1° C.

Example 15

12% by weight of the white conductive potassium titanate of 5Ω.cm (resistance), 18% by weight of zirconium oxide, and 70% by weight of polyester (IV 0.580) are mixed and melted with a two-spindle extruder, then quenched by water, cut into particles to obtain the mother particles of the mixed composition. The mother particles of the mixed composition is premixed with polyester (IV.0.645) at a ratio of 1:2 by weight, then mixed and melted with an extruder, which, in turn, will be used as the core of conjugate fiber, wherein the sheath of conjugate fiber is high-density polyethylene (M120). The two polymer components are fed into a core-in-sheath type conjugate filament-spinning machine, and the cross-sectional profile of the resultant conjugate fiber is as FIG. 9. The spinning ratio of the cores to the sheaths is 50/50 by weight. The unstretched filament of 7 denier per filament is obtained at a spinning temperature of 280° C. and a rolling velocity of 1100 m/min through an aperture of 0.25 mm ϕ. Then bunching the unstretched filament into cotton bundle of 600,000 denier, which, in turn, is drawn at a temperature of 80° C. at a draw ratio of 3.6, heat-set at 110° C., crimped with a crimper, dried at 80° C., and cut into heat-retaining thermally bondable staple fibers which is 51 mm in length and 2 denier per filament. 60 weight parts of the heat-retaining thermally bondable staple fibers and 40 weight parts of common polyester staple fibers without the particles of the present invention are mixed, carded, knitted, thermally bonded and then fabricated into nonwoven fabrics. Test the effectiveness of heat-retaining of the nonwoven fabrics—the temperature of the back of the fabrics is 49.6° C., ΔT=4.6° C.

Although the invention has been explained in relation to its preferred embodiment, it is to be understood that many other possible modifications and variations can be made without departing from the spirit and scope of the invention as hereinafter claimed.

What is claimed is:

1. A process for making heat-retaining fibers, comprising:

adding (1) 0.05–20 wt % of white conductive particles, and (2) 0.1–20 wt % of white particles with good radiating efficiency of far-infrared radiation into the fiber-forming polymer to obtain a mixed composition, wherein the total amount of said two types of particles are under 20 wt %; and melting and drawing the mixed composition with one extruder to obtain heat-retaining filaments or heat-retaining staple fibers.

2. A process for making heat-retaining fibers as claimed in claim 1, wherein the resistance of the white conductive particles is under 1000Ω.cm.

3. A process for making heat-retaining fibers as claimed in claim 1, wherein the average radiation rate of the white particles with good radiating efficiency of far-infrared radiation is above 65% at a temperature under 30° C. and wavelength between 4~25 μm.

4. A process for making heat-retaining fibers as claimed in claim 2, wherein the white conductive particles is selected from the group consisting of white conductive tin oxide, white conductive titanium dioxide, white conductive barium sulfate, white conductive potassium titanate, and mixtures of any two or more mentioned above at any ratio.

5. A process for making heat-retaining fibers as claimed in claim 3, wherein the white particles with good radiating efficiency of far-infrared radiation is selected from the group consisting of zirconium oxide, aluminum oxide, titanium dioxide, kaolin, magnesium oxide, and mixtures of any two or more mentioned above at any ratio.

6. A process for making heat-retaining fibers as claimed in claim 1, wherein the fiber-forming polymer is selected from the group consisting of polyester, polyamide, polyethylene, polypropylene, and substantially one kind of the above-mentioned polymer but denaturalized by co-polymerized monomer, or co-polymerized with compound of multi-functional group as long as the fiber-forming property unaffected.

7. A process for making heat-retaining fibers as claimed in claim 1, wherein (1) the white conductive particles and (2) the white particles with good radiating efficiency of far-infrared radiation are added in the synthetic stage of polymer, or directly mixed with the polymer material in the spinning of filaments, or made into concentrated mother particles, which, in turn, mixed with polymer material and diluted to the predetermined concentration; and the adding order of these two types of particles has no special limitation, either the white conductive particles or the white particles with good radiating efficiency of far-infrared radiation are added first, or they are added simultaneously.

8. A process for making heat-retaining fibers, comprising:

adding (1) 0.05–20 wt % of white conductive particles, and (2) 0.1–20 wt % of white particles with good radiating efficiency of far-infrared radiation into the fiber-forming polymer to obtain a mixed composition, wherein the total amount of said two types of particles are under 20 wt %; and melting and drawing the mixed composition and the fiber-forming polymer without the particles of the present invention with one extruder to obtain heat-retaining conjugate filaments or heat-retaining conjugate staple fibers.

9. A process for making heat-retaining fibers as claimed in claim 8, wherein the resistance of the white conductive particles is under 1000 Ω.cm.

10. A process for making heat-retaining fibers as claimed in claim 8, wherein the average radiation rate of the white particles with good radiating efficiency of far-infrared radiation is above 65% at a temperature under 30° C. and wavelength between 4~25 μm.

11. A process for making heat-retaining fibers as claimed in claim 9, wherein the white conductive particles is selected from the group consisting of white conductive tin oxide, white conductive titanium dioxide, white conductive barium sulfate, white conductive potassium titanate, and mixtures of any two or more mentioned above at any ratio.

12. A process for making heat-retaining fibers as claimed in claim 10, wherein the white particles with good radiating efficiency of far-infrared radiation is selected from the group consisting of zirconium oxide, aluminum oxide, titanium dioxide, kaolin, magnesium oxide, and mixtures of any two or more mentioned above at any ratio.

13. A process for making heat-retaining fibers as claimed in claim 8, wherein the fiber-forming polymer is selected from the group consisting of polyester, polyamide, polyethylene, polypropylene, and substantially one kind of the above-mentioned polymer but denaturalized by co-polymerized monomer, or co-polymerized with compound of multi-functional group as long as the fiber-forming property unaffected.

14. A process for making heat-retaining fibers as claimed in claim 8, wherein (1) the white conductive particles and (2) the white particles with good radiating efficiency of far-infrared radiation are added in the synthetic stage of polymer, or directly mixed with the polymer material in the spinning of filaments, or made into concentrated mother particles, which, in turn, mixed with polymer material and diluted to the predetermined concentration; and the adding order of these two types of particles has no special limitation, either the white conductive particles or the white particles with good radiating efficiency of far-infrared radiation can be added first, or they are added simultaneously.

* * * * *